US010563947B2

(12) United States Patent
Sawicki

(10) Patent No.: US 10,563,947 B2
(45) Date of Patent: Feb. 18, 2020

(54) TRAINING MAGAZINE AND SAFETY SYSTEM FOR FIREARMS

(71) Applicant: Michael Sawicki, Sanibel, FL (US)

(72) Inventor: Michael Sawicki, Sanibel, FL (US)

( * ) Notice: Subject to any disclaimer, the term of this patent is extended or adjusted under 35 U.S.C. 154(b) by 277 days.

(21) Appl. No.: 15/804,153

(22) Filed: Nov. 6, 2017

(65) Prior Publication Data

US 2018/0128570 A1 May 10, 2018

Related U.S. Application Data

(60) Provisional application No. 62/419,996, filed on Nov. 10, 2016.

(51) Int. Cl.
*F41A 33/00* (2006.01)

(52) U.S. Cl.
CPC ..... *F41A 33/00* (2013.01)

(58) Field of Classification Search
CPC ..... F41A 33/00; F41A 33/02; F41A 33/04; F41A 33/06; F41A 17/00; F41A 17/36; F41A 17/44; F41A 29/04
See application file for complete search history.

(56) References Cited

U.S. PATENT DOCUMENTS 4,413,437 A 11/1983 Anderson
4,619,062 A 10/1986 Johnson
4,709,496 A 12/1987 Johnson
5,974,717 A 11/1999 Brooks
6,237,272 B1 5/2001 Scott
7,222,450 B2 * 5/2007 Cuprin ..... F41A 17/066 42/70.11
7,240,449 B2 7/2007 Clifton, Jr.
7,287,456 B2 10/2007 Spielberger
7,318,294 B2 1/2008 Zimmermann
7,543,403 B1 6/2009 Schaefer
7,966,759 B2 6/2011 Bentley
8,434,254 B1 5/2013 Watchorn et al.
8,484,877 B2 7/2013 Zimmermann
8,590,203 B1 11/2013 McCarthy
8,931,467 B2 1/2015 Lee
9,310,149 B2 4/2016 Masters
9,618,285 B2 4/2017 Leimer
(Continued)

OTHER PUBLICATIONS

AR Rifle Locking Mechanism—MagVault /Gun Valut, 2015; printed on May 26, 2016; http://www.gunvault.com/gun-locks/magvault.html; 2 pages.

(Continued)

*Primary Examiner* — Timothy A Musselman
(74) *Attorney, Agent, or Firm* — Kilyk & Bowersox, P.L.L.C.

(57) ABSTRACT

A training magazine and safety system for a magazine-fed firearm are provided. The training magazine includes a safety block at a top of the magazine, configured to block the breach of the firearm and thus keep the bolt of the firearm locked to the rear such that the firearm is incapable of firing. The safety block can include a notch in a front portion thereof, which is configured to accommodate a chamber flag while the chamber flag is in the chamber of a firearm. As such, the chamber flag and training magazine can be used together as a safety system. Methods of training are also provided.

20 Claims, 16 Drawing Sheets

(56) References Cited

U.S. PATENT DOCUMENTS 10,422,601 B2 * 9/2019 Harris ..... F41A 9/65

OTHER PUBLICATIONS

Training Magazines from BlueGun; printed on May 26, 2016; http://www.alternateforce.net/bluemagazines.html; 1 page.
Chamber Safety Flags/Training & Safety Gear at Brownells; printed on May 26, 2016; http://www.brownells.com/shooting-accessoriese/training-safety-gear/chamber-safety-flags/ . . . ; 2 pages.
AR-15 Magwell Safety Plug/Brownells; printed on May 26, 2016; http://www.brownells.com/shooting-accessoriese/training-safety-gear/chamber-safety-flags/ . . . ; 2 pages.
Training Gun Magazines; 1980-2016; printed on May 26, 2016; http://asp-usa.com/store/training/product/148-training-gun-magazines; 3 pages.
Red Gun; © 1980-2016; printed on May 26, 2016; http://asp-usa.com/store/training/category/67-red-gun; 8 pages.

* cited by examiner

TRAINING MAGAZINE AND SAFETY SYSTEM FOR FIREARMS

CROSS-REFERENCE TO RELATED APPLICATION

This application claims priority under 35 USC § 119 to U.S. Provisional Application No. 62/419,996, filed Nov. 10, 2016, and entitled Training Magazine and Safety System for Weapons, the entire contents of which are hereby incorporated by reference.

FIELD OF THE INVENTION

The present invention relates to a training magazine and safety system for weapons.

BACKGROUND OF THE INVENTION

For training purposes, semi-automatic magazine-fed weapons are typically unloaded and a chamber flag is inserted into the emptied chamber. The chamber flag provides a visual confirmation to others that the chamber is empty. The chamber flag is of a bright color, such as yellow, and extends above the chamber so that is can be easily seen by others. Chamber flags should not be used with emptied magazines due to the increased likelihood of introducing live ammunition and the inability of the user/trainers to readily identify an unloaded weapon. Accordingly, using a chamber flag with an empty magazine is unacceptable. Additionally, an empty magazine would not correctly simulate the weight of a loaded magazine. The use of currently commercially available dummy magazines in conjunction with a chamber flag is also not acceptable in light of manufacturers stating that such dummy magazines are not intended for use in real weapons and are designed as props and to add weight to equipment pouches during training.

Conventional dummy or training magazines lack the full shape and weight of a real magazine and, when used in training, cause users to develop training postures that cannot be assumed or could not be mimicked when the weapon is loaded with an authentic magazine. Some gun locks are available that can be used to block a weapon chamber, but not in the form of a dummy or training magazine. A need exists for a better training magazine and a better safety system for weapons.

SUMMARY OF THE INVENTION

The present invention provides a training magazine for use with semi-automatic magazine-fed weapons, which includes a safety block at the top of the magazine, which keeps the bolt of the weapon locked to the rear by blocking the breach. The locked bolt renders the weapon incapable of firing. The training magazine is sized and weighted to approximate the profile and heft of a loaded authentic magazine for the weapon, thus promoting realistic training.

The present invention also relates to the safety system for a semi-automatic magazine-fed weapon, which comprises a training magazine as described herein that further includes a notch cut out of or formed in the safety block so that the training magazine can be inserted into and engage a weapon while a chamber flag is disposed in the weapon chamber. The safety system can comprise the training magazine and chamber flag such that training can be conducted with a training magazine of authentic shape and weight and that can be used in conjunction with the chamber flag. The safety system thus affords a 360° visual confirmation of a safe weapon in a training environment.

DETAILED DESCRIPTION OF THE INVENTION

Figure 1:
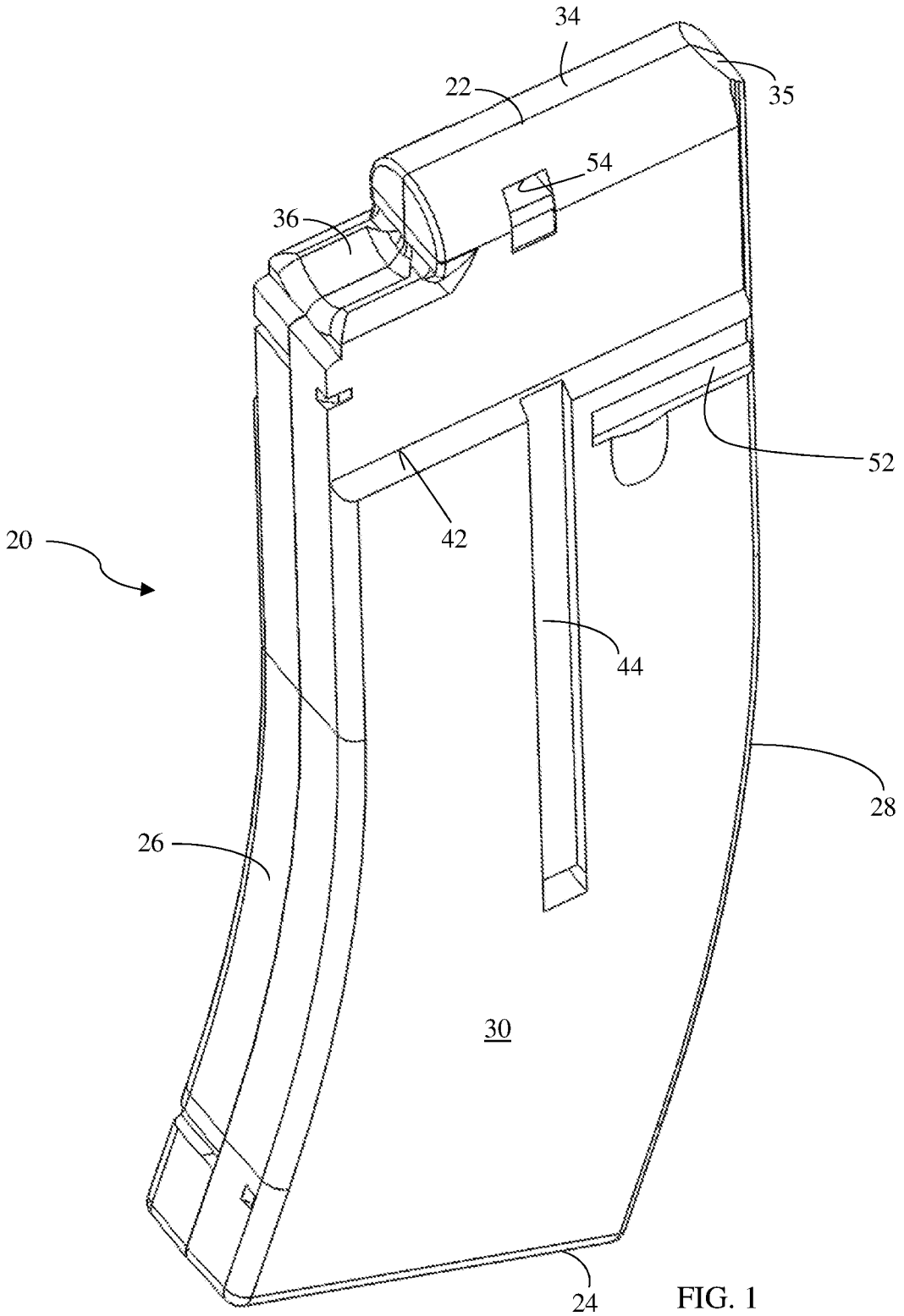
FIG. 1 is a top, left, front perspective view of the training magazine, according to various embodiments of the present invention.
Figure 2:
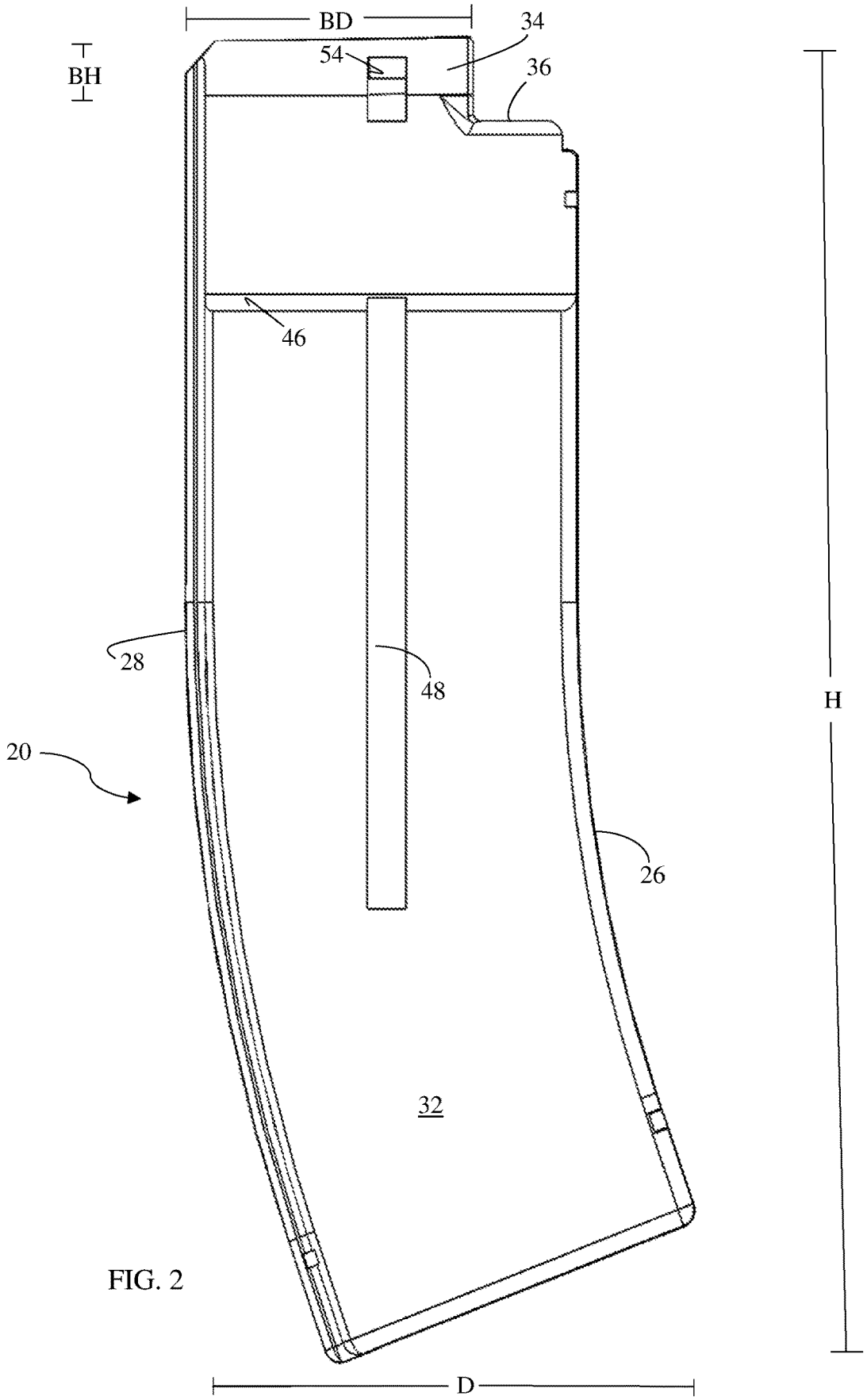
FIG. 2 is a right-side, side view of the training magazine shown in FIG. 1.
Figure 3:
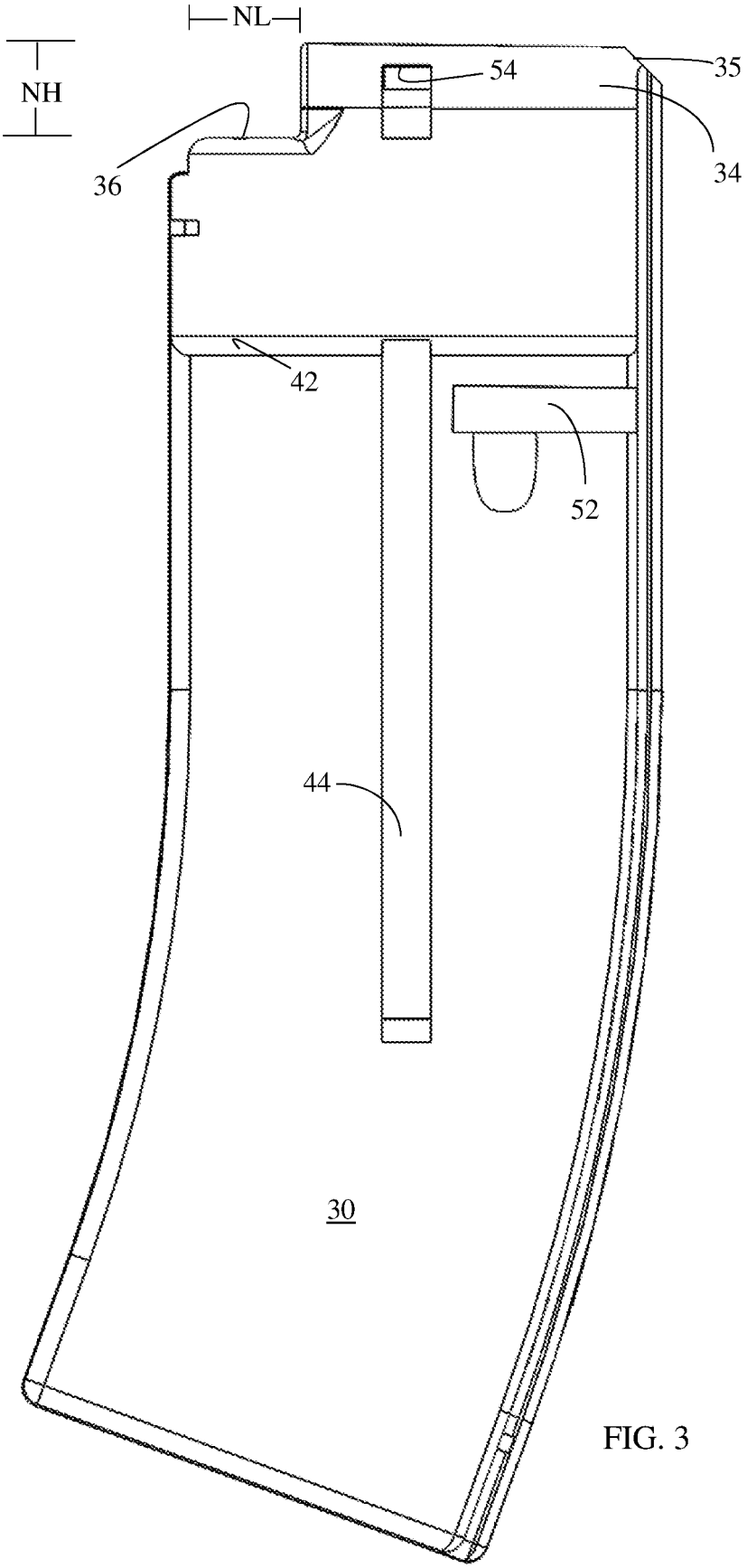
FIG. 3 is a left-side, side view of the training magazine shown in FIGS. 1 and 2.

The present invention provides a training magazine for a magazine-fed firearm, for example, a semi-automatic magazine-fed rifle. The training magazine comprises a training magazine body and a safety block on top of the body. The body and the safety block can be integrally formed together, for example, molded of a plastic material in a monolithic, one-piece construction. Alternatively, the safety block can be formed separately from the body and the two components can be connected together to form the training magazine. Together, the training magazine body and safety block provide a training magazine having the size, shape, and weight of a fully-loaded cartridge magazine for the firearm. Depending on the firearm with which the training magazine is to be used, the training magazine can be shaped and weighted to have the same size, shape, and weight as a fully-loaded cartridge magazine for that particular firearm.

In various examples, the training magazine can have a weight of from about 15 ounces to about 18 ounces, for example, about 16.4 ounces, or exactly 16.4 ounces.

The training magazine can be formed of any suitable material that provides an authentic weight when formed into a suitable size and shape. In exemplary embodiments, the training magazine can be molded, formed, or shaped from a metal material, a polymeric material, a plastic material, a resin material, a rubber material, or the like. The training magazine can alternatively be formed by 3D printing or by carving or etching away at an oversized monolith. The material of the training magazine can comprise a filler, for example, a weighted filler. In some embodiments the training magazine can be formed of a plastic material comprising a dense filler, a metal filler, or the like, such as metal shot, metal ingots, metal shards, metal washers, metal bars, metal discs, metal powders, metal beads, a length of metal bar, a length of rebar, stacked metal elements, stacked metal washers, or the like.

According to various embodiments, the training magazine can comprise a notch formed in the top thereof, for example, a notch formed in the front of the safety block. The notch can be sized and shaped, or otherwise configured, to accommodate at least a portion of a chamber flag when the chamber flag is disposed in a chamber of a firearm with which the training magazine is designed to operate. When inserted into a magazine catch of the firearm, the safety block can be disposed in the breach of the firearm, and the notch can accommodate the body of the chamber flag disposed in the chamber of the firearm. As such, the training magazine and chamber flag, together, can provide a safety system in accordance with the present invention. The training magazine and chamber flag can be of the same color, for example, a yellow, orange, or red color. The chamber flag and training magazine can be of different colors. Bright or neon colors can be used to provide a readily visible indication to others that the firearm has been rendered incapable of firing and is temporarily modified for training purposes.

The present invention also provides a firearm that has been rendered incapable of firing by incorporation of a safety system of the present invention. The firearm comprises a chamber and a breach and the chamber flag can be configured to fit into the chamber. The safety block can be configured to fit into the breach and block the breach. The training magazine can be configured to be inserted into a magazine catch of the firearm and to mimic the size and weight of a fully-loaded cartridge magazine for the firearm. A firearm incapable of firing can be provided wherein the chamber flag is disposed in the chamber, the training magazine is disposed in the magazine catch, and the safety block is disposed in the breach.

The present invention also provides a method of firearm training. According to the method, a training magazine according to the present invention is provided for a magazine-fed firearm and inserted into a magazine catch for the firearm. The safety block of the training magazine can block the breach of the firearm rendering the firearm incapable of firing. Training with the firearm, for example, walking, jogging, running, jumping, and positioning oneself while carrying the training firearm, can mimic training with a firearm containing or holding a fully-loaded cartridge magazine. The training can also comprise detaching the training magazine from the firearm and re-inserting it, or inserting a different training magazine, into the magazine catch of the firearm.

According to various embodiments, training methods are also provided whereby a chamber flag is first inserted into the chamber of a firearm. Subsequently, a training magazine comprising a notch, and according to the present invention, can be inserted into the magazine catch of the firearm while the chamber flag remains in the chamber. The notch of the training magazine can enable the training magazine to be inserted into the magazine catch, and locked in place, while the chamber flag remains in the chamber. As a result, a two-point safety system is provided whereby both a chamber flag and a training magazine can be used to provide safe, yet authentic, training with the firearm. The training can also comprise carrying one or more additional training magazines of the present invention on one's person, for example, on a belt, vest, holster, or backpack, during training.

The safety block of the training magazine is sized and shaped to effectively block the weapon chamber, and can be integrally molded with, or attached to, the remainder of the training magazine. For example, the training magazine can be of a single, unitary, one-piece construction, or can comprise two or more pieces connected together. A notch or cut-out can be seen at the front of the safety block to allow the use of a chamber flag that can occupy an otherwise empty weapon chamber. The chamber flag can provide visual confirmation of an empty chamber. The training magazine can also be of a bright color, such as yellow, orange, pink, red, neon green, or the like, so that others can easily recognize that the weapon is a training weapon and, specifically, is safe, and not loaded. A safety system including the same bright orange for the chamber flag and for the training magazine can easily and readily be recognized as having rendered the firearm incapable of firing. Used together, the training magazine and the chamber flag provide a safety system that affords a 360° visual confirmation of a safe weapon in a training environment.

The training magazine provides the correct shape and profile of a loaded weapon, when engaged with a weapon. Training with the correct shape and profile of a loaded weapon can promote the development of good training postures that can also be assumed when the weapon is loaded with a real magazine. The training magazine can be formed of a solid polymer, other polymeric materials, a filled polymer, metal, wood, or any other material that would provide the approximate heft of a fully loaded or partially loaded magazine for the corresponding weapon. Polyalkylene polymers or polymer blends can be used in some embodiments. Polymer materials filled with metal powders, shot, fibers, strips, or pieces, can be used to form the training magazine.

The training magazine can be configured to match or closely resemble the form of an AR-15® magazine, an M16 magazine, an M4 magazine, or the like. AR-15 is a registered trademark of Colt Manufacturing Company LLC of West Hartford, Conn. The training magazine can be used with, and shaped to engage, any of a variety of semi-automatic magazine-fed weapons that include a reciprocating bolt, for example, models such as the MP5, UMP, G3, G36, HK416, and other models available from Heckler and Koch (HK), as well as other models including the AK-47 and the like. Such weapons, in combination with the training magazine and the safety system of the present invention, are also provided according to the present invention, as are methods of training using the training magazine and the safety system of the present invention, and methods of forming a training weapon by incorporating the training magazine and safety system of the present invention in a weapon.

Exemplary dimensions of the training magazine, its features, and the catch port of a corresponding magazine-fed weapon can be as follows. The dimensions can correspond to the actual dimensions of an authentic magazine for a corresponding weapon, with the exception of the notch provided according to the present invention. For example, the dimensions can correspond substantially (within a 5% deviation) or exactly to the dimensions of a 5.56 mm NATO STANAG/USGI style magazine, which are commonly used in the AR-15®/M16/M4 rifles. Also listed below are dimensions for the small rectangular hole into which the rifle's magazine catch engages to hold the magazine in the rifle. For clarity, such a hole is referred to herein as a "catch port." The catch port (CP) can be punched out of sheet metal on a USGI magazine so the depth is all the way through to the magazine's opposite side wall. A depth of about 0.15" can be used as a minimum for the rifle's magazine catch to engage and hold onto the training magazine.

The width (W) of the training magazine can be, for example, from about 0.88" to about 0.99", or about 0.883". The depth (D) of the training magazine can be, for example, from about 2.51" to about 2.53", or about 2.523". The overall height (H) of the training magazine can be, for example, from about 7.75" to about 7.85", or about 7.80". The block height (BH) from rear feed lip of the training magazine can be, for example, from about 0.7" to about 0.8", or about 0.73". The block height from front feed lip of the training magazine can be, for example, from about 0.8" to about 0.85", or about 0.82". The block width (BW) of the training magazine can be, for example, from about 0.6" to about 0.7", or about 0.65". The block length (depth) (BD) of the training magazine can be, for example, from about 2.0" to about 2.5", or about 2.22". The length of the notch (NL) can be, for example, from about 0.5" to about 0.6", or about 0.53". The width of the notch (NW) can be, for example, from about 0.4" to about 0.55", or about 0.47". The height of the notch (NH) can be, for example, from about 0.4" to about 0.5", or about 0.43".

The distance from the catch port rear to the magazine body rear can be, for example, from about 0.37" to about 0.43", or about 0.395". The distance from the catch port rear to the rear ridge or seam can be, for example, from about 0.55" to about 0.6", or about 0.573". The catch port height can be, for example, from about 0.25" to about 0.26", or about 0.253". The catch port width can be, for example, from about 0.39" to about 0.52", or about 0.446". The catch port depth can be, for example, from about 0.15" or greater.

The weight of the training magazine can vary depending upon the specific weapon is it to be used with, but can range, for example, from about 14 ounces to about 20 ounces, from about 15.25 ounces to about 18 ounces, from about 16 ounces to about 17 ounces, or can be about 16.4 ounces.

With reference to the drawing figures, and particularly FIGS. 1-7, a training magazine 20 according to various embodiments of the present invention, is shown. Training magazine 20 has a top 22, a bottom 24, a front 26, a rear 28, a left side 30, and a right side 32. At top 22 of training magazine 20 a safety block 34 is provided. Safety block 34 can be integrally formed or molded with the rest of the training magazine 20, or it can be separately made and attached to the remainder of training magazine 20. Safety block 34 is provided with a beveled corner 35 to facilitate insertion of training magazine 20 into a semi-automatic weapon such as a long rifle. Training magazine 20 includes a notch 36 formed at top 22 adjacent safety block 34 and at the opposite end of safety block 34 relative to where beveled corner 35 is provided.

Training magazine 20 is configured to have the same shape and weight as a fully operational, loaded cartridge magazine for the same semi-automatic weapon for which training magazine 20 is designed. The weapon, for example, a semi-automatic long rifle, is provided with a magazine well into which top 22 of training magazine 20 is to be inserted. For this purpose, training magazine 20 is provided with side grooves 44 and 48 on the left side and right side, respectively, which are sized and shaped to engage guide rails or other protruding features provided in, or with, the magazine well. Together, the side grooves and rails guide training magazine 20 into the magazine well during insertion of the training magazine into the magazine well. Shoulders 42 and 46 are also provided, on left side 30 and right side 32, respectively, of training magazine 20, for the purpose of preventing insertion of training magazine 20 too far into the magazine well. Other features for guiding and locking training magazine 20 into the magazine well of a semi-automatic long rifle or other firearm can include one or more horizontal grooves 52 and one or more through-hole features such as through-hole 54. Locking features, for example, latches, spring-biased hooks, rails, and pins can be provided in, or in connection with, the magazine well to lock training magazine 20 into the magazine well upon proper insertion into the magazine well. The grooves and other guiding features of training magazine 20 can ensure proper insertion of training magazine 20 into the magazine well and can block or prevent backward or other improper insertion of training magazine 20.

Figure 4:
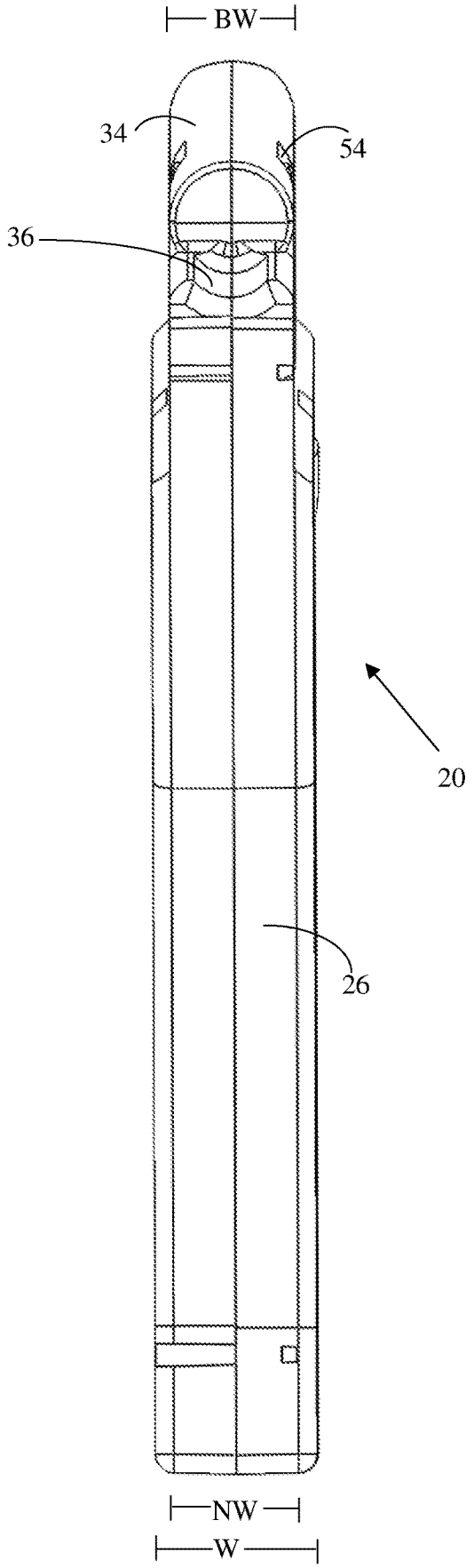
FIG. 4 is a front view of the training magazine shown in FIGS. 1-3.
Figure 5:
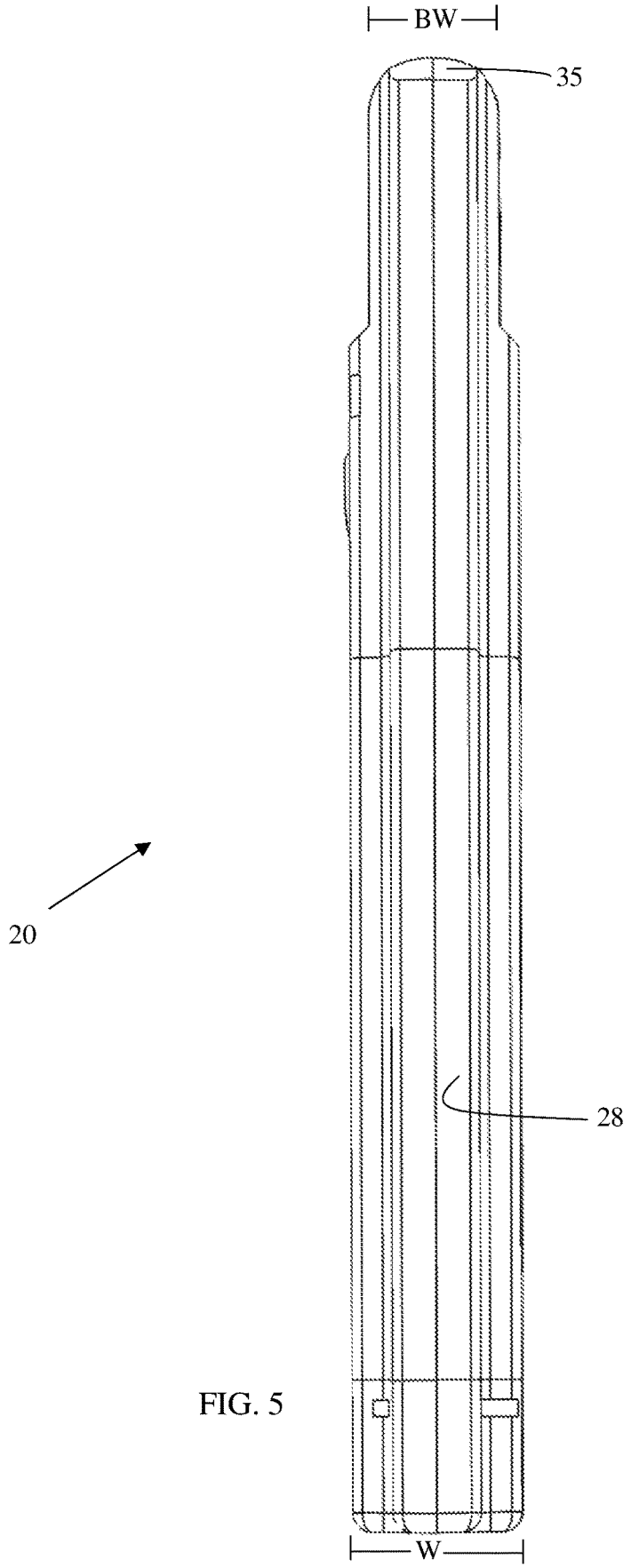
FIG. 5 is a back view of the training magazine shown in FIGS. 1-4.
Figure 6:
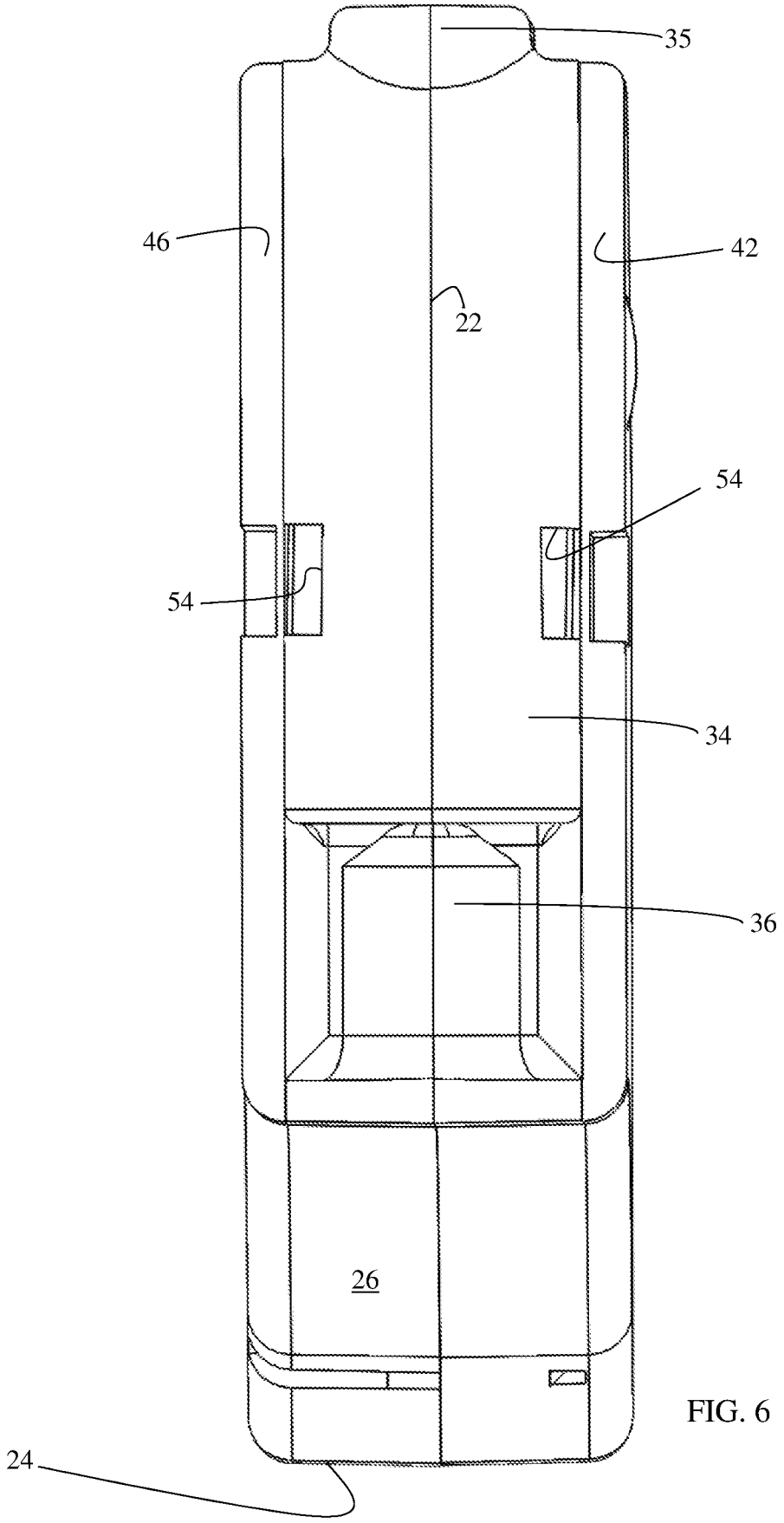
FIG. 6 is a top view of the training magazine shown in FIGS. 1-5.
Figure 7:
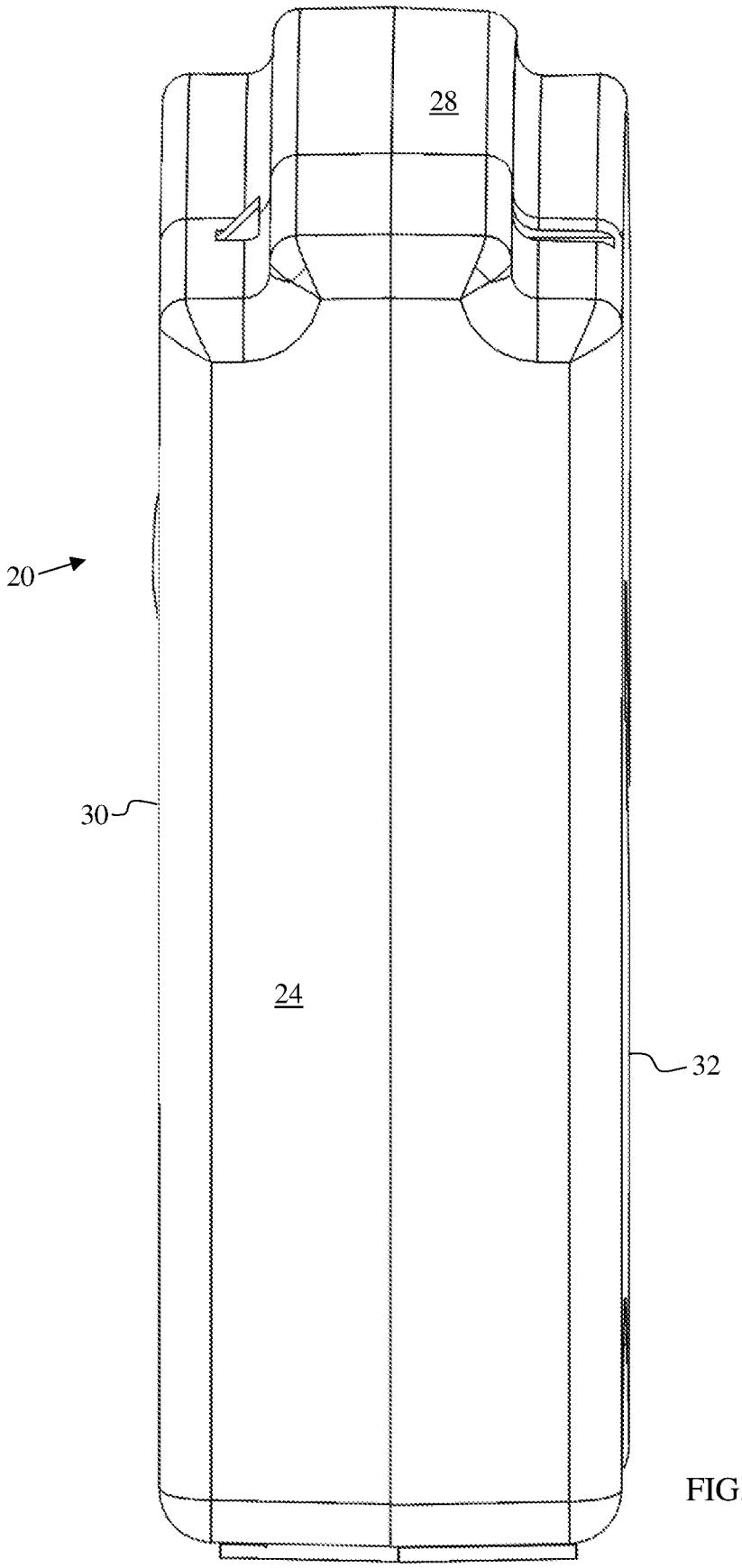
FIG. 7 is a bottom view of the training magazine shown in FIGS. 1-6.
Figure 8:
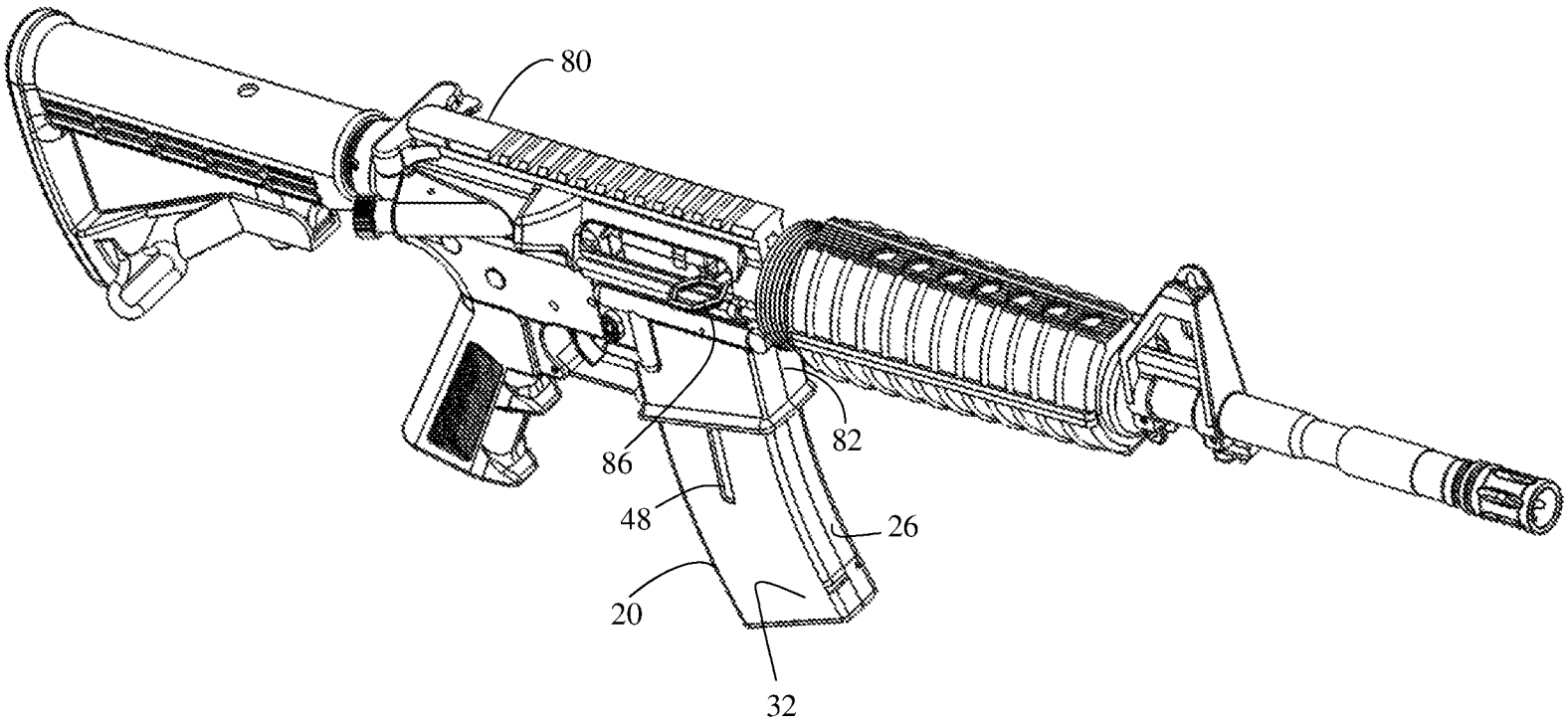
FIG. 8 is a top, right, front perspective view of a semi-automatic rifle having the safety system, including the training magazine, of the present invention engaged therein.
Figure 9:
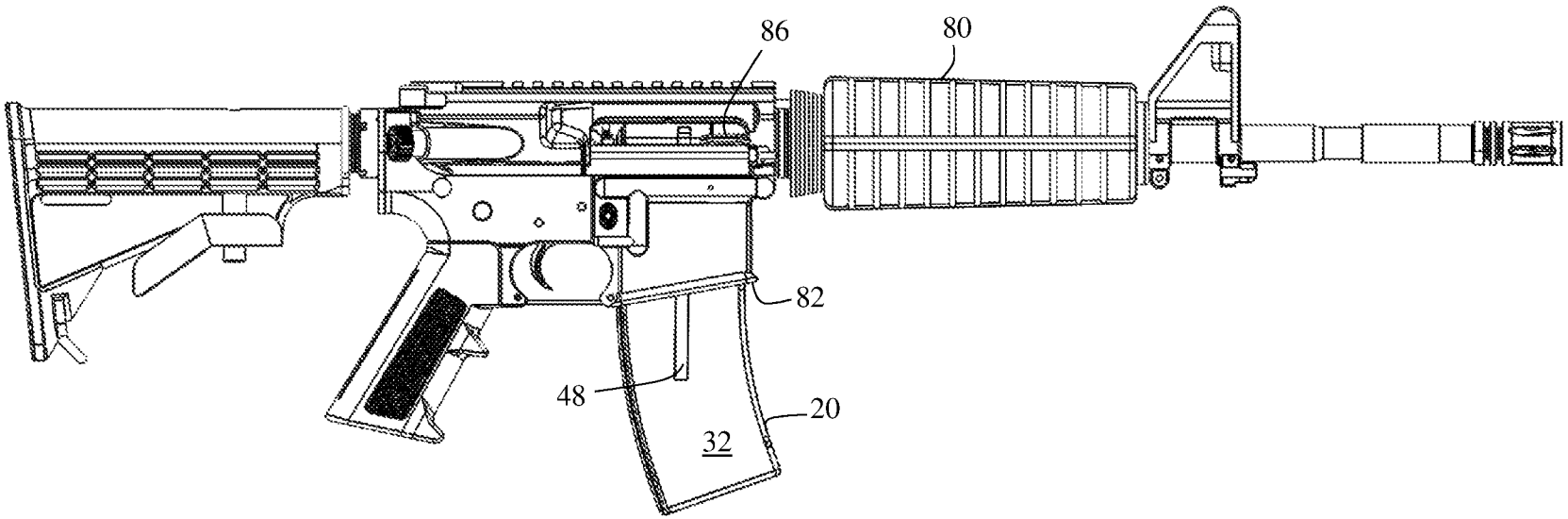
FIG. 9 is a right-side, side view of the semi-automatic rifle with safety system including training magazine, shown in FIG. 8.
Figure 10:
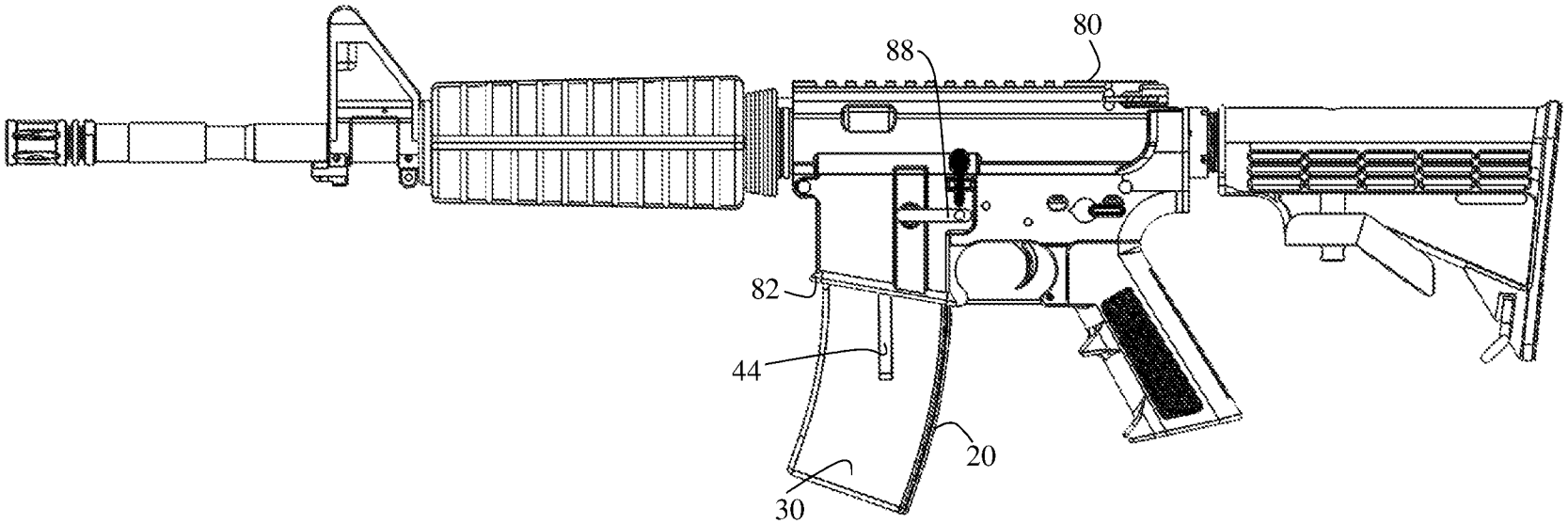
FIG. 10 is a left-side, side view of the semi-automatic rifle with safety system including training magazine, shown in FIGS. 8 and 9.
Figure 11:
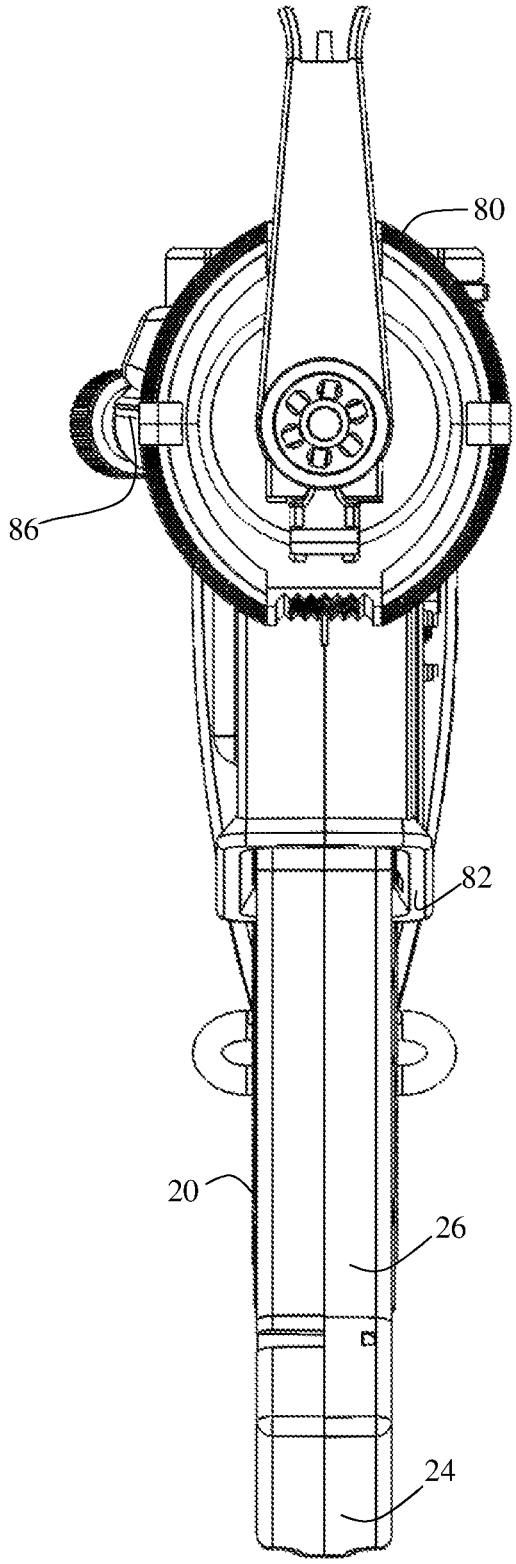
FIG. 11 is a front view of the semi-automatic rifle with safety system including training magazine, shown in FIGS. 8-10.
Figure 12:
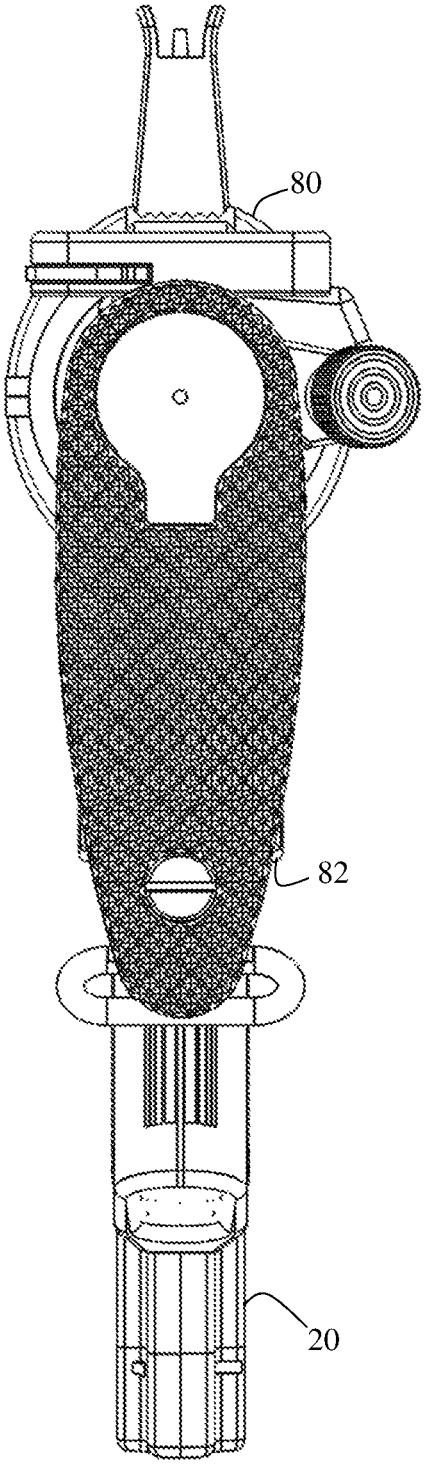
FIG. 12 is a back view of the semi-automatic rifle with safety system including training magazine, shown in FIGS. 8-11.
Figure 13:
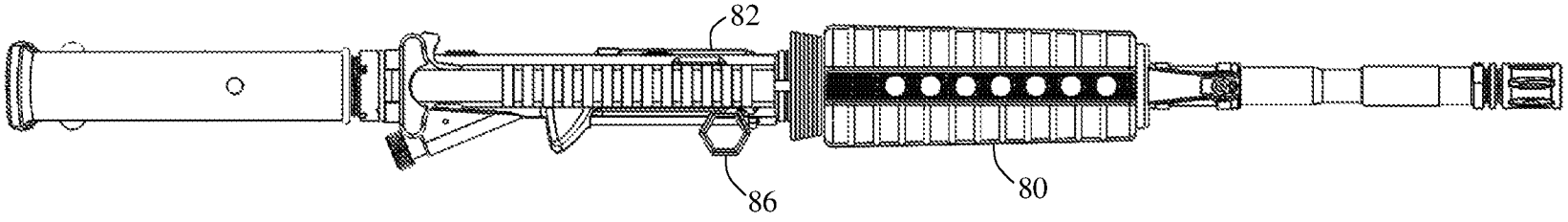
FIG. 13 is a top view of the semi-automatic rifle with safety system including training magazine, shown in FIGS. 8-12.
Figure 14:
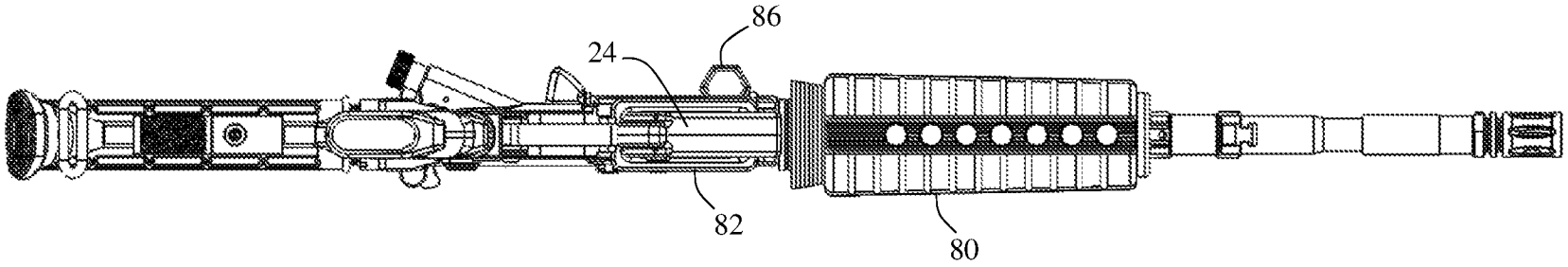
FIG. 14 is a bottom view of the semi-automatic rifle with safety system including training magazine, shown in FIGS. 8-13.

As shown in FIGS. 1 and 4, notch 36 can be formed to have a rounded bottom wall, for example, having the same or a similar radius of curvature as the inner surface of the barrel of the firearm with which the training magazine is designed for use. The rounded bottom can also accommodate and/or be configured to fit a chamber body of a chamber flag.

The groves 44 and 48 can be provided with a through-hole (not shown) at the lower ends thereof, extending through the magazine and intersecting both grooves, for the purpose of receiving a cable tie or zip tie useful to tie, lock, or otherwise secure the magazine to a firearm. The through-hole can be used alone or in conjunction with through-hole 54, to secure the magazine to the firearm. The grooves or side channels 44 and 48 can extend between such a lower through-hole and through-hole 54 at the top of the training magazine. The grooves and through-holes can enable the feeding of a zip tie or cable tie through the ejection port of the rifle and around the magazine. The use of a zip tie or cable tie for this purpose enables an operator to secure the training magazine into the firearm to prevent removal of, or loss of, the training magazine in the field. A zip tie or cable tie can also be used to comply with gun range or expo venue rules that require weapon actions, such as a firearm magazine feeding mechanism, to be locked with a zip tie.

FIGS. 8-14 are various views of a semi-automatic firearm in the form of an M16 rifle 80, configured as a training firearm and incorporating a safety system in accordance with various embodiments of the present invention. The safety system includes a training magazine 20 as described herein, and a chamber flag 86 that includes a chamber flag body inserted into the chamber of rifle 80. Rifle 80 comprises a magazine catch 82 into which is inserted training magazine 20. The reference numerals used to designate various features of training magazine 20 refer to the same features described above and designated by the same reference numerals in FIGS. 1-7.

Rifle 80 includes a magazine disconnect lock 88 that is spring-biased inwardly into magazine catch 82, and that includes a locking pin at the distal end thereof. The locking pin protrudes into and engages groove 52 (FIGS. 1 and 3) of training magazine 20 to lock training magazine 20 into magazine catch 82. The locking engagement can operate just like the engagement with a fully-loaded cartridge magazine. Magazine disconnect lock 88 can be provided on the left side of some firearms and on the right side of other firearms, and the training magazine 20 can be figured to accommodate engagement on either or both sides.

In an exemplary method, a trainee can insert training magazine 20 into magazine catch 82 of rifle 80 until magazine disconnect lock 88 engages groove 52 of training magazine 20. Some firearms can be designed such that the engagement results in an audible click. The trainee can then depress a release tab on magazine disconnect lock 88 such that lock 88 is longer engaged with groove 52. While disengaged, the trainee then detach training magazine 20 from rifle 80 and pull training magazine 20 out of magazine catch 82. The trainee can then re-insert the same training magazine 20 into magazine catch 82 or insert a different training magazine into magazine catch 82, to simulate exchanging an empty cartridge magazine for a fully-loaded cartridge magazine. The safety system of the present invention, including notch 36 of training magazine 20, enables the insertion and exchange of a training magazine while chamber flag 86 remains disposed within the chamber of rifle 80. Other people around, or training with, the trainee can readily be made aware that rifle 80 is configured as a training firearm by recognizing chamber flag 86, a unique color of chamber flag 86, training magazine 20, a unique color of training magazine 20, or a combination thereof. The unique color can be, for example, a bright yellow, a bright orange, or a bright red.

Figure 15:
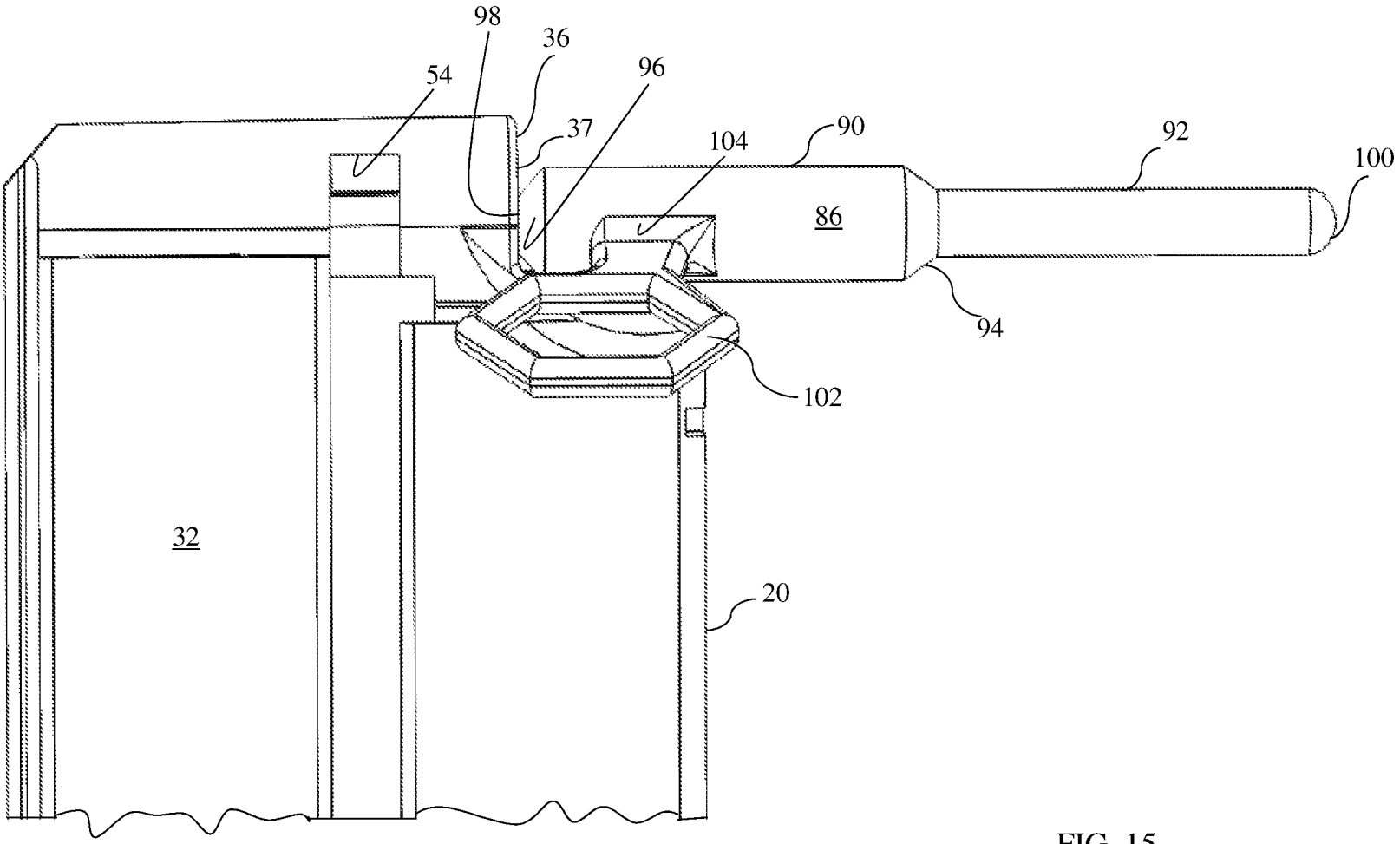
FIG. 15 is a right-side view of a safety system of the present invention showing the spatial relationship between the training magazine of the present invention and the chamber flag.
Figure 16:
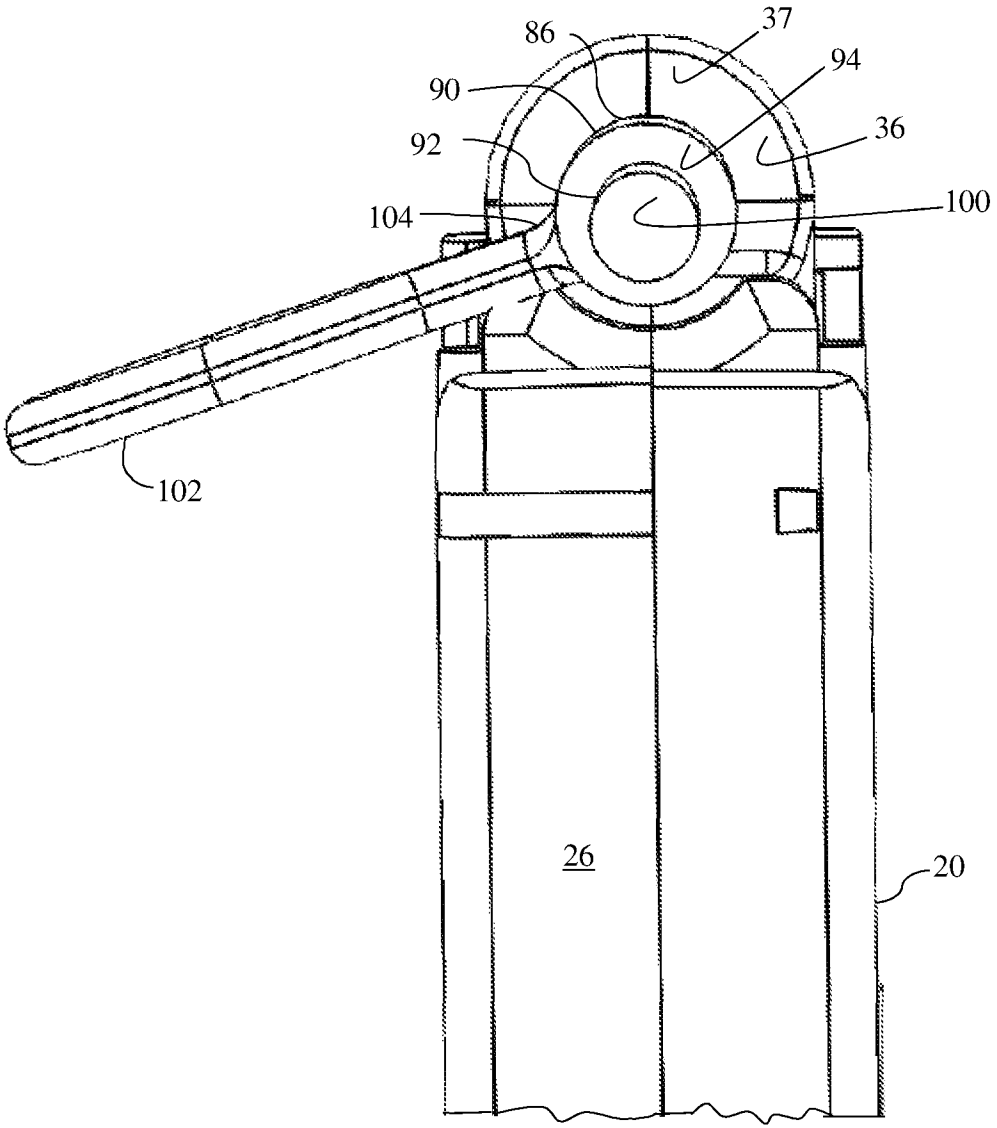
FIG. 16 is a front view of the safety system shown in FIG. 15.

FIGS. 15 and 16 are a right-side view and a front view, respectively, of a safety system according to embodiments of the present invention, showing the spatial relationship between training magazine 20 and chamber flag 86 as they would be arranged in operation. As can be seen, chamber flag 86 comprises a main body 90, a narrow front portion 92, a mid-transition 94 where main body 90 intersects with narrow front portion 92, a rear-transition 96, a rounded front end 100, and a flat vertical rear face 98. Rear face 98 abuts a vertical face 37 of notch 36 when chamber flag 86 and training magazine 20 are installed in a firearm. As can be seen, notch 36 provides a space for accommodating a rear portion of chamber flag 86. Chamber flag 86 also comprises a visible ring flag 102 that is connected to main body 90 at a flag transition 104 where visible ring flag 102 merges into main body 90. Chamber flag 86 can be made of separate components assembled together or can be integrally molded so as to be of a one-piece construction. When inserted into a chamber of a firearm, the majority of chamber flag 86 may be hidden from view but visible ring flag 102 would protrude from the breach of the firearm and thus be visible, even once installed.

Also shown and labelled in FIGS. 15 and 16 are right side 32, front 26, and through-hole 54 of training magazine 20.

As can be seen in the drawings, the training magazine of the present invention includes a safety block situated at the top of the magazine, which keeps the weapon bolt locked to the rear by blocking the breach, thereby rendering the weapon incapable of firing. The training magazine can be molded of a resin material such as a thermoplastic material that can be filled with weighted fillers, such as shot, so that the magazine can approximate the authentic size and weight, and thus the profile and heft, of an authentic, fully-loaded cartridge magazine. When engaged with the weapon, the training magazine enables the training weapon to approximate the profile and heft of an authentic loaded weapon and thus promotes realistic training.

The present invention includes the following numbered aspects, embodiments, and features, in any order and/or in any combination:

1. A training magazine of any preceding or following embodiment/feature/aspect for a magazine-fed firearm having a breach, the training magazine comprising:
   a training magazine body; and
   a safety block at a top of the training magazine body, the safety block configured to occupy the breach of the firearm to render the firearm incapable of firing, wherein
   the training magazine has the size and weight of a fully-loaded cartridge magazine for the firearm.

2. The training magazine of any preceding or following embodiment/feature/aspect, wherein the training magazine has a weight from about 15 ounces to about 18 ounces.

3. The training magazine of any preceding or following embodiment/feature/aspect, wherein the training magazine has a weight of about 16.4 ounces.

4. The training magazine of any preceding or following embodiment/feature/aspect, wherein the training magazine is of a single, unitary, one-piece construction.

5. The training magazine of any preceding or following embodiment/feature/aspect, wherein the training magazine is of a two-piece construction comprising the safety block and the training magazine body connected together.

6. The training magazine of any preceding or following embodiment/feature/aspect, wherein the entire training magazine is molded and comprises a plastic material and a weighted filler.

7. The training magazine of any preceding or following embodiment/feature/aspect, wherein the safety block has a front and further comprises a notch formed in the front.

8. A safety system comprising the training magazine of any preceding or following embodiment/feature/aspect and a chamber flag, wherein the notch is sized and configured to accommodate at least a portion of the chamber flag when the chamber flag is disposed in a chamber of a firearm and the safety block is disposed in a breach of the firearm.

9. The safety system of any preceding or following embodiment/feature/aspect, wherein the chamber flag is of a yellow color and the training magazine is of a yellow or red color.

10. The safety system of any preceding or following embodiment/feature/aspect, wherein the chamber flag and the training magazine are of the same color.

11. In combination, a firearm and the safety system of any preceding or following embodiment/feature/aspect, wherein the firearm comprises a chamber and a breach, the chamber flag is disposed in the chamber, and the safety block is disposed in the breach.

12. The combination of any preceding or following embodiment/feature/aspect, wherein the firearm comprises a semi-automatic, magazine-fed, long rifle.

13. The combination of any preceding or following embodiment/feature/aspect, wherein the firearm comprises an AR-15®, an M16, an M4, or an AK-47.

14. A method of firearm training, comprising:
   providing a firearm having a chamber and a breach;
   providing the safety system of any preceding or following embodiment/feature/aspect;
   inserting the chamber flag into the chamber of the firearm; and
   then inserting the training magazine into the firearm such that the safety block occupies and blocks the breach of the firearm and the notch accommodates the chamber flag while the chamber flag is in the chamber.

15. The method of any preceding or following embodiment/feature/aspect, further comprising locking the training magazine to the firearm.

16. The method of any preceding or following embodiment/feature/aspect, further comprising:

unlocking the training magazine from the firearm;

detaching the training magazine from the firearm while leaving the chamber flag in the chamber;

re-inserting the training magazine into the firearm; and locking the training magazine to the firearm for a second time.

17. The method of any preceding or following embodiment/feature/aspect, further comprising:

unlocking the training magazine from the firearm;

detaching the training magazine from the firearm while leaving the chamber flag in the chamber; and inserting a second training magazine into the firearm, the second training magazine comprising a second safety block and a second notch, wherein the second safety block occupies and blocks the breach of the firearm and the second notch accommodates the chamber flag while the chamber flag is in the chamber.

18. The method of any preceding or following embodiment/feature/aspect, further comprising locking the second training magazine to the firearm.

19. A method of firearm training, comprising:

providing the training magazine of any preceding or following embodiment/feature/aspect; and inserting the training magazine into a magazine catch of a magazine-fed firearm having a breach, such that the safety block occupies the breach and renders the firearm incapable of firing.

20. The method of any preceding embodiment/feature/aspect, further comprising:

locking the training magazine to the firearm; and assuming a shooter's position.

The present invention can include any combination of these various features or embodiments above and/or below, as set forth in the foregoing sentences and/or paragraphs. Any combination of disclosed features herein is considered part of the present invention and no limitation is intended with respect to combinable features.

Applicant specifically incorporates the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such specific ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range. Unless otherwise defined, the term "about" means within a deviation of from 3% to negative 3% of the value specified.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A training magazine for a magazine-fed firearm having a breach, the training magazine comprising:

a training magazine body; and a safety block at a top of the training magazine body, the safety block configured to occupy the breach of the firearm to render the firearm incapable of firing, wherein the training magazine has the size and weight of a fully-loaded cartridge magazine for the firearm.

2. The training magazine of claim 1, wherein the training magazine has a weight from about 15 ounces to about 18 ounces.

3. The training magazine of claim 1, wherein the training magazine has a weight of about 16.4 ounces.

4. The training magazine of claim 1, wherein the training magazine is of a single, unitary, one-piece construction.

5. The training magazine of claim 1, wherein the training magazine is of a two-piece construction comprising the safety block and the training magazine body connected together.

6. The training magazine of claim 1, wherein the entire training magazine is molded and comprises a plastic material and a weighted filler.

7. The training magazine of claim 1, wherein the safety block has a front and further comprises a notch formed in the front.

8. A safety system comprising the training magazine of claim 7 and a chamber flag, wherein the notch is sized and configured to accommodate at least a portion of the chamber flag when the chamber flag is disposed in a chamber of a firearm and the safety block is disposed in a breach of the firearm.

9. The safety system of claim 8, wherein the chamber flag is of a bright orange color and the training magazine is of the same bright orange color.

10. The safety system of claim 8, wherein the chamber flag and the training magazine are of the same color.

11. In combination, a firearm and the safety system of claim 8, wherein the firearm comprises a chamber and a breach, the chamber flag is disposed in the chamber, and the safety block is disposed in the breach.

12. The combination of claim 11, wherein the firearm comprises a semi-automatic, magazine-fed, long rifle.

13. The combination of claim 12, wherein the firearm comprises an AR-15®, an M16, an M4, or an AK-47.

14. A method of firearm training, comprising:

providing a firearm having a chamber and a breach;

providing the safety system of claim 8;

inserting the chamber flag into the chamber of the firearm; and then inserting the training magazine into the firearm such that the safety block occupies and blocks the breach of the firearm and the notch accommodates the chamber flag while the chamber flag is in the chamber.

15. The method of claim 14, further comprising locking the training magazine to the firearm.

16. The method of claim 15, further comprising:

unlocking the training magazine from the firearm;

detaching the training magazine from the firearm while leaving the chamber flag in the chamber;

re-inserting the training magazine into the firearm; and locking the training magazine to the firearm for a second time.

17. The method of claim 15, further comprising:

unlocking the training magazine from the firearm;

detaching the training magazine from the firearm while leaving the chamber flag in the chamber; and inserting a second training magazine into the firearm, the second training magazine comprising a second safety block and a second notch, wherein the second safety block occupies and blocks the breach of the firearm and the second notch accommodates the chamber flag while the chamber flag is in the chamber.

18. The method of claim 17, further comprising locking the second training magazine to the firearm.

19. A method of firearm training, comprising:

providing the training magazine of claim 1;

inserting the training magazine into a magazine catch of a magazine-fed firearm having a breach, such that the safety block occupies the breach and renders the firearm incapable of firing.

20. The method of claim 19, further comprising:

locking the training magazine to the firearm; and assuming a shooter's position.

* * * * *